US006017320A

United States Patent [19]

Bleeker et al.

[11] Patent Number: 6,017,320

[45] Date of Patent: Jan. 25, 2000

[54] MASSAGING APPARATUS HAVING TWO ROLLERS AND A SUCTION CHAMBER

[75] Inventors: Jean B. Bleeker, Delfzijl; Gert J. Drent, Groningen, both of Netherlands; Wolfgang Obermann, Krumpendorf, Austria

[73] Assignee: U.S. Philips Corporation, New York, N.Y.

[21] Appl. No.: 08/891,607

[22] Filed: Jul. 11, 1997

[30] Foreign Application Priority Data

Jul. 15, 1996 [EP] European Pat. Off. ..... 96890121

[51] Int. Cl.[7] ..... A61H 15/00

[52] U.S. Cl. ..... 601/125; 601/122; 601/133; 601/6

[58] Field of Search ..... 601/6, 7, 8, 122, 601/123, 125, 126, 133, 134, 135; 15/384

[56] References Cited

U.S. PATENT DOCUMENTS

| | | | |
|---|---|---|---|
| 1,268,963 | 6/1918 | Gray | 15/384 |
| 1,514,949 | 11/1924 | Bell et al. | 15/384 |
| 1,663,167 | 3/1928 | Koester | 601/6 |
| 1,840,796 | 1/1932 | Schweers | 601/6 |
| 2,574,601 | 11/1951 | Swanson | 601/6 |
| 3,297,024 | 1/1967 | Robinson | 601/6 |
| 4,729,368 | 3/1988 | Guitay | 601/6 |
| 4,883,047 | 11/1989 | Guitay | 601/6 |
| 5,086,539 | 2/1992 | Rench | 15/384 |
| 5,127,128 | 7/1992 | Lee | 15/384 |
| 5,665,053 | 9/1997 | Jacobs | 601/6 |

FOREIGN PATENT DOCUMENTS

| | | | |
|---|---|---|---|
| 503630 | 7/1930 | Germany | 15/384 |

*Primary Examiner*—Richard J. Apley
*Assistant Examiner*—Benjamin K. Koo
*Attorney, Agent, or Firm*—Edward W. Goodman

[57] ABSTRACT

In a massaging apparatus with two rotatable rollers, which are spaced apart transversely to their roller spindles, and with a suction chamber disposed in the area of the two rollers and having two transverse walls extending transversely to the roller spindles and two longitudinal walls extending parallel to the roller spindles, this suction chamber being connected to a pump via an air-transfer connection for generating a vacuum in the suction chamber so as to form a skin fold which is drawn into the suction chamber, at least one longitudinal wall is disposed between the two rollers and the free end of a longitudinal wall disposed between the two rollers extends up to the circumferential surface of the roller adjacent this free end in that area of its circumferential surface which faces the other roller.

14 Claims, 5 Drawing Sheets

MASSAGING APPARATUS HAVING TWO ROLLERS AND A SUCTION CHAMBER

BACKGROUND OF THE INVENTION

1. Field of the Invention

The invention relates to a massaging apparatus comprising two rollers which are each rotatable about one of two mutually parallel spaced-apart roller spindles, these rollers are to be placed onto the skin of a person with their circumferential surfaces and are rotationally drivable in a given direction of rotation when the massaging apparatus with its two rollers is moved over the skin of a person in a given operating direction which extends transversely to the roller spindles. The massaging apparatus further comprises a suction chamber in the area of the two rollers, this suction chamber enclosing a suction space and comprising two transverse walls, which extend substantially perpendicularly to the roller spindles, and two longitudinal walls, which extend parallel to the roller spindles, are connected to the two transverse walls, and each has a free end adjacent the circumferential surface of a roller, this suction chamber being open in its area which faces a person's skin when the rollers are applied to the skin of a person and is connected to a pump for the transfer of air via an air-transfer connection, the pump—with the rollers applied to the skin of a person—being capable of generating a partial vacuum in the suction chamber in order to form a skin fold which is drawn into the suction chamber.

2. Description of the Related Art

Such a massaging apparatus of the type defined in the opening paragraph is known, for example, from the document U.S. Pat. No. 4,729,368. In this known massaging apparatus, the two rollers are disposed inside the suction chamber in such a manner that both the two longitudinal walls and the two transverse walls of the suction chamber extend around the rollers. This results in a comparatively large contact area with which the suction chamber is in contact with a person's skin during operation of the massaging apparatus. Due to this comparatively large contact area of the known apparatus, it is comparatively difficult to achieve a proper sealing between the skin of a person and the suction chamber. Moreover, as a result of the comparatively large contact area, comparatively large frictional forces occur between the skin of a person and the longitudinal walls and transverse walls of the suction chamber. Furthermore, due to the comparatively large contact area, the partial vacuum generated in the suction chamber gives rise to a comparatively high surface pressure between the skin of a person and the portions of the two longitudinal walls and the two transverse walls of the suction chamber which cooperate with the skin, as a result of which, comparatively large forces are required to move the massaging apparatus over the skin of a person. Due to the fact that the rollers are disposed inside the suction chamber and the longitudinal walls and the transverse walls of the suction chamber consequently extend around the rollers, the suction chamber has a comparatively large volume, as a result of which the evacuation of air from the suction chamber, by means of a pump having a given pump capacity, takes a comparatively long time in order to reach a certain desired vacuum, and the massaging apparatus also becomes comparatively bulky, while it is further necessary that the roller spindles extend through the transverse walls, which gives rise to undesired leaks and, as a consequence, air leakage problems at the suction chamber. In order to mitigate a further air leakage problem at the suction chamber the known massaging apparatus further comprises two sealing flaps which are pivotally mounted at the location of a cover wall of the suction chamber, which also enclose the two rollers, and, during operation of this massaging apparatus, engage with the circumferential surface portions of the two rollers which are remote from one another, in order to obtain a sealing inside the suction chamber. However, since the degree of soiling of the rollers increases as the operating time increases, skin particles and other contaminants settling on the circumferential surfaces of the two rollers, causing an undesirable clearance between the sealing flaps and the circumferential surfaces of the two rollers, these two sealing flaps do not provide a proper sealing. Finally, another problem of the known massaging apparatus is that in operation of the massaging apparatus, a person's skin may be caught or get pinched between the roller, which is situated at the rear in the given operating direction, and the adjacent longitudinal wall of the suction chamber.

SUMMARY OF THE INVENTION

It is an object of the invention to preclude the above-mentioned problems and to provide an improved and simplified massaging apparatus of the type defined in the opening paragraph.

To achieve this object, in accordance with the invention, a massaging apparatus of the type defined in the opening paragraph is characterized in that at least one longitudinal wall of the suction chamber is disposed substantially between the two rollers, and the free end of the longitudinal wall disposed between the two rollers extends up to the circumferential surface of the roller adjacent this free end in that area of its circumferential surface which faces the other roller. In this way, it is achieved that the contact area of the suction chamber with the skin is comparatively small, so that it is relatively simple to achieve a proper sealing between the skin of a person and the suction chamber, i.e., the two longitudinal walls and the two transverse walls of this suction chamber. The comparatively small contact area of the suction chamber with the skin has the advantage that comparatively small frictional forces occur between the walls of the suction chamber and a person's skin and the surface pressure between the walls of the suction chamber and a person's skin is comparatively low, as a result of which the massaging apparatus can be moved over a person's skin with comparatively small forces. A further advantage is that the suction chamber can have a comparatively small volume, as a result of which the evacuation of air from the suction chamber by means of a pump having a given pump capacity takes a comparatively short time in order to reach a certain desired vacuum, and such a massaging apparatus can be of comparatively compact and simple construction. Moreover, it is thus possible to realize a massaging apparatus in accordance with the invention in which the suction chamber does not give rise to any air leakage problems at all or only to minor air leakage problems.

In a massaging apparatus in accordance with the invention, at least that longitudinal side wall of the suction chamber, whose free end extends up to the circumferential surface of the roller which is situated at the front in the given operating direction, can be interposed between the two rollers. However, in a massaging apparatus in accordance with the invention, it has proven to be advantageous if at least that longitudinal wall of the suction chamber, whose free end extends up to the circumferential surface of the rearward roller, viewed in the given operating direction, is disposed substantially between the two rollers. In this way, it is achieved that, at least at the location of the roller situated at the rear in the given operating direction, there is no risk of pinching between this rearward roller and that longitudinal wall of the suction chamber, which extends up to this roller.

In a massaging apparatus in accordance with the invention as mentioned in the preceding paragraph, it has proven to be very advantageous if a dirt scraper is disposed adjacent that area of the circumferential surface of the rearward roller, viewed in the given operating direction, which is remote from forward roller, viewed in the given operating direction, this scraper being urged onto the circumferential surface of the rearward roller, viewed in the given operating direction, by means of at least one spring. Thus, it is achieved by simple means that no ingress of dirt into the massaging apparatus is possible at the location of the rearward roller in the given operating direction, and that a person's skin cannot get caught or pinched at the location of the roller situated at the rear in the given operating direction, because this is precluded by the dirt scraper which is urged onto the circumferential surface of this roller.

In all the massaging apparatuses defined hereinbefore, it has proven to be particularly advantageous if the two longitudinal walls of the suction chamber are disposed substantially between the two rollers. In this way, a very small contact area of the suction chamber with a person's skin is obtained, as a result of which a very good sealing between a person's skin and the walls of the suction chamber is obtained and very small frictional forces and a very low surface pressure occur between the walls of the suction chamber and a person's skin. Moreover, this enables a very small volume of the suction chamber and a very compact construction of a massaging apparatus to be obtained. Another very important advantage of such a massaging apparatus, in accordance with the invention, is that the suction chamber itself is absolutely sealed because the two transverse walls have no passages for leading through or for supporting the roller spindles, so that there are absolutely no air leakage problems caused by the bearing means of the rollers, and a particularly rapid build-up of a vacuum in the perfectly sealed suction chamber is possible.

In a massaging apparatus of the type defined in the preceding paragraph, it has proven to be particularly advantageous, in addition, that the two transverse walls of the suction chamber are also disposed substantially between the two rollers. This is advantageous for a particularly small contact area of the suction chamber with a person's skin, and for a particularly compact construction of the suction chamber.

In a massaging apparatus of the type defined in the preceding paragraph, it has proven to be particularly advantageous if the two longitudinal walls and the two transverse walls of the suction chamber form a dome-like suction space of substantially ellipsoidal shape without any corners inside the suction chamber. This is advantageous for a particularly gentle cooperation of the suction chamber with a skin portion drawn into the suction chamber, and for a desired comparatively high mechanical stiffness of the suction chamber.

In massaging apparatuses in accordance with the invention, in which both longitudinal walls of the suction chamber are disposed between the two rollers, it has further proven to be very advantageous if bearing walls, which extend transversely to the roller spindles and which project laterally from the suction chamber, are fixedly connected to the suction chamber disposed between the two rollers, and the two rollers are rotatably supported by means of the bearing walls. This has the advantage that by means of the supporting walls, the two rollers are rotatably supported in a fixed relationship with respect to the suction chamber, i.e., with respect to the two longitudinal walls and the two transverse walls of the suction chamber, which is advantageous in view of a constant relative position of a roller with respect to its adjacent longitudinal wall and, consequently, in view of a constant air gap between a roller and its adjacent longitudinal wall.

In a massaging apparatus of the type defined in the preceding paragraph, it has proven to be very advantageous if the suction chamber forms part of a suction chamber support, the bearing walls form parts of a bearing device, and the suction chamber support is fixedly connected to the bearing device. This is favorable for an advantageous construction of the apparatus.

In all the massaging apparatuses defined hereinbefore, it has proven to be very advantageous if, of the two rollers, at least the forward roller, viewed in the given operating direction, has a circumferential surface with a surface roughness in a range between 0 $\mu$m and 2 $\mu$m. By giving the circumferential surface of at least the forward roller, viewed in the given operating direction, such a surface roughness, this roller being constructed as a mirror-finish smooth roller of a comparatively hard material, a particularly good adhesion of the roller on a person's skin and, hence, a good cooperation of the roller with a person's skin are achieved. It is to be noted that the two rollers can have a circumferential surface with a surface roughness ranging between 0 $\mu$m and 2 $\mu$m, but that the rearward roller, viewed in the given operating direction, can also have a higher surface roughness and can be made of a comparatively soft material.

In all the massaging apparatuses defined hereinbefore, it has further proven to be very advantageous if the two longitudinal walls and the two transverse walls of the suction chamber have a surface roughness in a range between 4 $\mu$m and 8 $\mu$m at the location of their bounding surfaces which can be brought into contact with the skin of a person. For a minimal adhesion of the suction chamber walls to a person's skin and, consequently, a minimal friction between the suction chamber walls and a person's skin, it has proven to be very favorable if there is such a surface roughness at the location of those bounding surfaces of the two longitudinal walls and the two transverse walls of the suction chamber which can be brought into contact with a person's skin.

In all the massaging apparatuses defined hereinbefore, it has further proven to be very advantageous if at least, for the greater part, the free end of each of the two longitudinal walls recedes towards the apparatus interior with respect to a tangential plane common to the two rollers in their areas which face the skin of a person—with the rollers applied to the skin of a person. This is advantageous in view of a minimal friction of the longitudinal walls of the suction chamber on a person's skin, and in view of comparatively large contact areas of the two rollers on a person's skin.

In all the massaging apparatuses defined hereinbefore, it has further proven to be very advantageous if the free end of each of the two longitudinal walls extends up to the circumferential surface of a roller so as to form an air gap having a gap width of, at most, 0.2 mm. Thus, it becomes substantially impossible that a person's skin gets pinched between a roller and a longitudinal wall of the suction chamber.

In a massaging apparatus of the type defined in the preceding paragraph, it has also proven to be very advantageous if the free end of at least one longitudinal wall of the two longitudinal walls of the suction chamber is urged against the circumferential surface of the roller adjacent this free end under pre-load. This ensures that the free end of a longitudinal wall of the suction chamber always closely engages with the circumferential surface of the roller adjacent this free end, so that it is virtually impossible for a person's skin to get trapped between a roller and a longitudinal wall of the suction chamber.

In all the massaging apparatuses defined hereinbefore, it has further proven to be very advantageous if a roller, which, viewed in the given operating direction, is followed by a longitudinal wall of the suction chamber, has circumferential grooves, and the longitudinal wall following this roller has tooth-like wall extensions which each engage in a groove in this roller. This is advantageous in order to ensure that a person's skin is kept away effectively from the area of the gap between a roller and the longitudinal suction-chamber wall adjoining this roller.

The afore-mentioned as well as further aspects of the invention will be apparent from the exemplary embodiments described hereinafter and will be elucidated by means of these exemplary embodiments.

BRIEF DESCRIPTION OF THE DRAWINGS

The invention will now be described in more detail with reference to the drawings, which show five exemplary embodiments to which the invention is not limited, in which.

DESCRIPTION OF THE PREFERRED EMBODIMENTS

A massaging apparatus 1 embodying the invention will be described hereinafter with reference to FIGS. 1 to 6.

Figure 3:
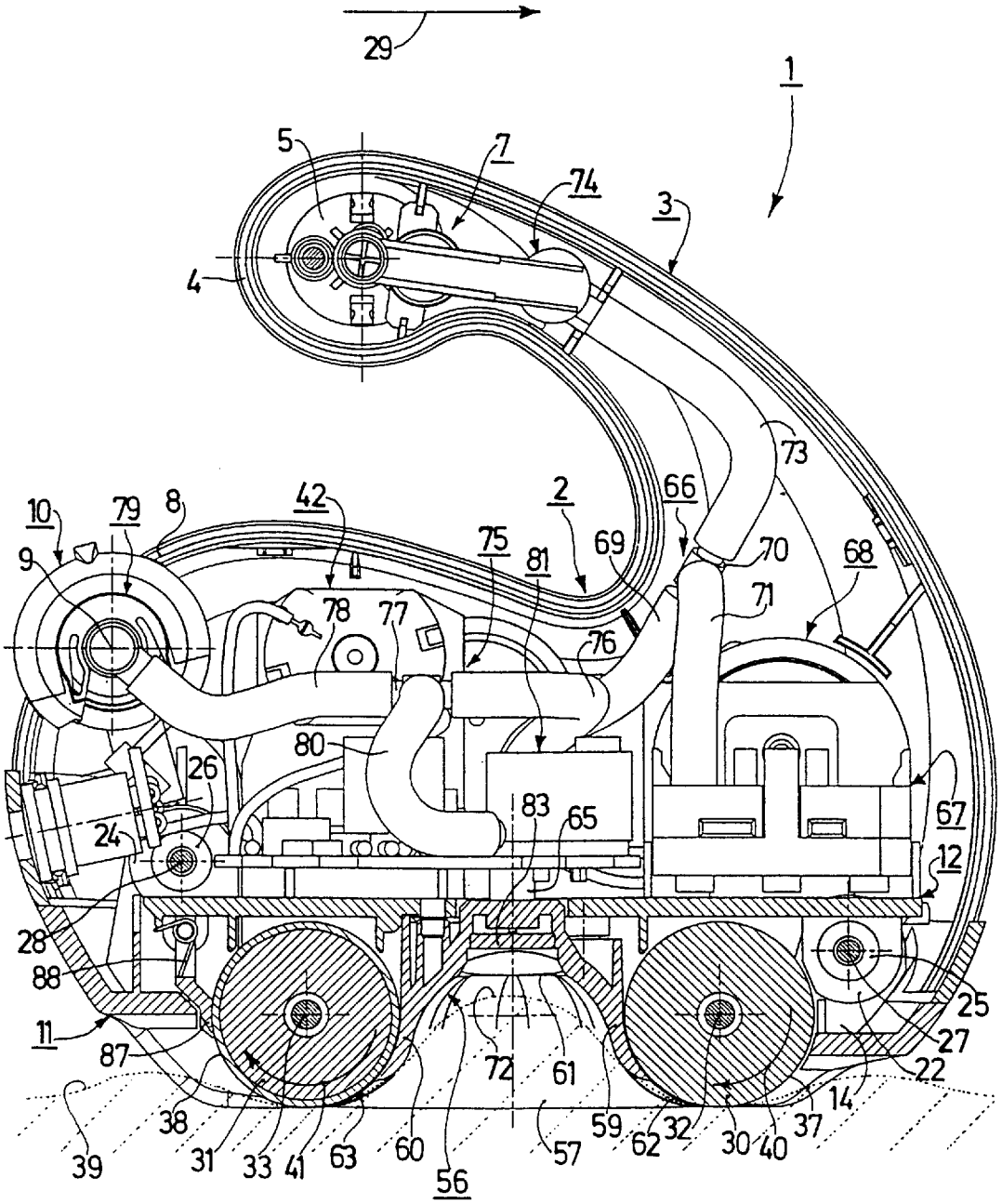
FIG. 3 shows a variant of the massaging apparatus of FIG. 1 in a sectional view also taken substantially across the center of the massaging apparatus but inverted with respect to the sectional view of FIG. 2, FIG. 3 showing, in particular, the means for generating and influencing the partial vacuum in the suction chamber of the massaging apparatus.

The massaging apparatus 1 comprises a housing 2 having a grip portion 3, which, at its free end, changes into an end portion 4 of substantially ellipsoidal shape, which can be gripped by the fingers of a hand. At the location of its two side faces, the end portion 4 has push-buttons 5 and 6, respectively. Each of the two push-buttons 5 and 6 serves for opening an air valve of a vacuum-elimination valve device 7, which is shown in FIG. 3. The vacuum-elimination valve device 7 will be described in more detail hereinafter.

A rotary knob 10, which is rotatable about an axis 9, projects from a part 8 of the housing 2. The rotary knob 10 can be set from an off-position into an on-position, and can then be set continuously from the on-position to various settings. When the rotary knob 10 is set from its off-position to its on-position, a pump or pump motor of the massaging apparatus 1 is switched on and, in addition, a power supply circuit for the roller drive motor is activated. The roller drive motor is, in fact, not started until a given vacuum is reached in a suction chamber of the massaging apparatus 1, which is detected by means of an electropneumatic vacuum switch, which turns on the roller drive motor when the given desired vacuum in the suction chamber is detected. By turning the rotary knob 10 from its on-position into one of its different settings a controllable vacuum control valve is set to different vacuum values, so that it is possible to obtain different partial vacuums on the suction chamber of the massaging apparatus 1 by means of the controllable vacuum control valve.

Figure 4:
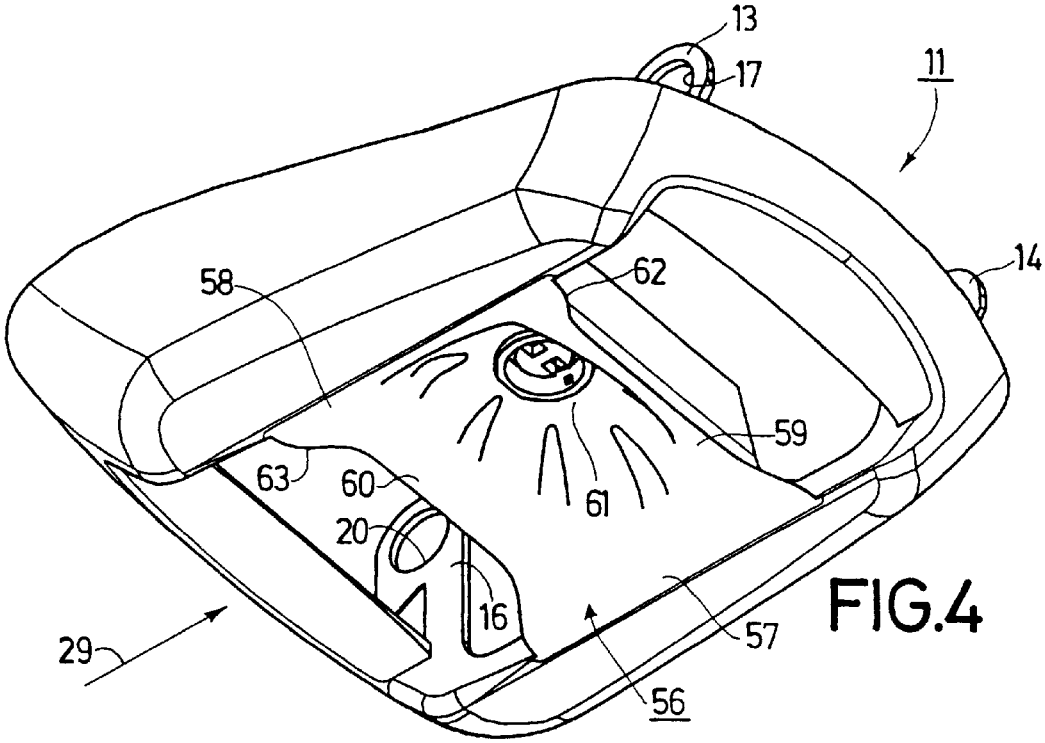
FIG. 4 is an oblique underneath view of a suction chamber support for the suction chamber of the massaging apparatus as shown in FIGS. 1 and 3.
Figure 5:
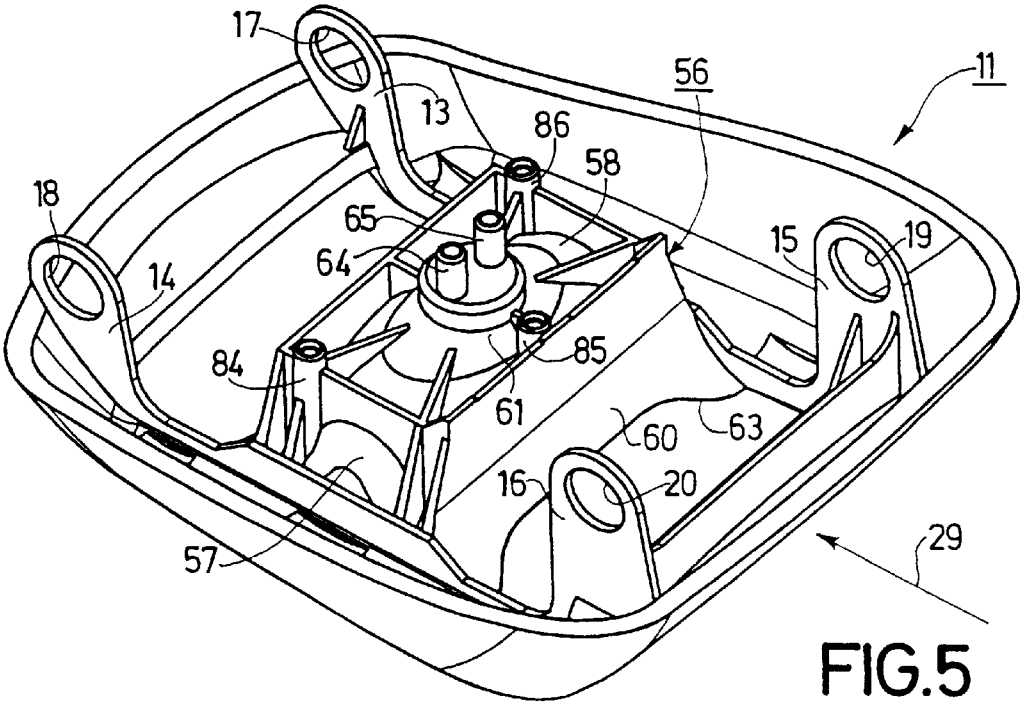
FIG. 5 is an oblique plan view of the suction chamber support shown in FIG. 4 for the massaging apparatus as shown in FIGS. 1 and 3.
Figure 6:
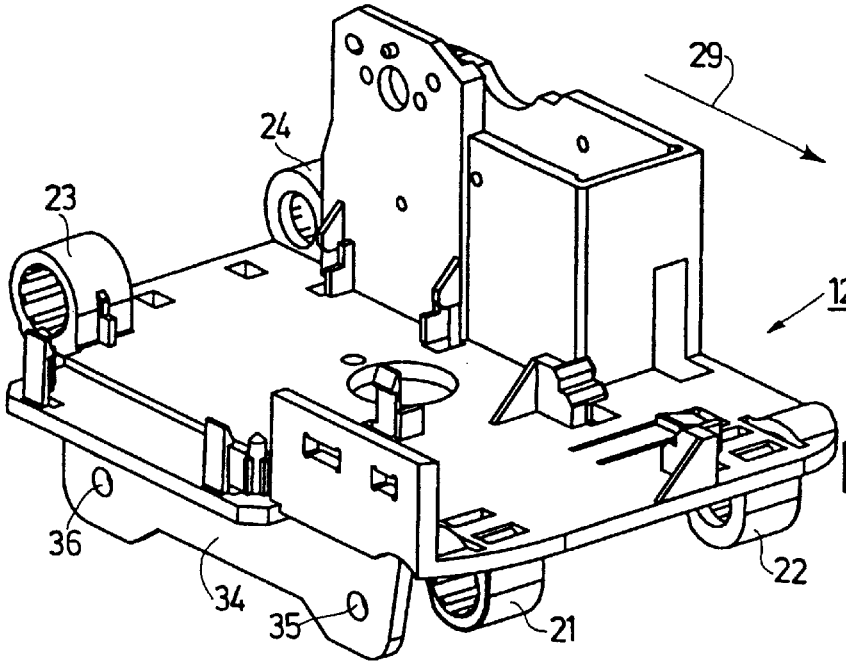
FIG. 6 is an oblique plan view of a bearing device included in the massaging apparatus in accordance with FIGS. 1 and 3, this bearing device serving for supporting the drive means for the rollers and for supporting the rollers themselves.

The massaging apparatus 1 further comprises a suction chamber support 11, which is shown separately in FIGS. 4 and 5. The suction chamber support 11 is fixedly connected to a bearing device 12 of the massaging apparatus 1. The bearing device 12 is shown separately in FIG. 6. To connect the suction chamber support 11 to the bearing device 12, the suction chamber support 11 comprises four lugs 13, 14, 15 and 16, which each have a bore 17, 18, 19 and 20, respectively, near their respective free ends. To connect the suction chamber support 11 to the bearing device 12, the bearing device 12 comprises four mounting sleeves 21, 22, 23 and 24. After the suction chamber support 11 and the bearing device. 12 have been assembled during assembly of the massaging apparatus 1, two hollow cylindrical sleeves 25 and 26, shown in FIG. 3, which sleeves are made of a rubber-like material and serve as damping means, are passed through the bores 17, 18 and the mounting sleeves 21, 22 as well as the bores 19, 20 and the mounting sleeves 23, 24, after which a bolt 27, 28 is passed through each hollow cylindrical sleeve 25, 26 and a nut, not shown, is fitted onto each bolt 27, 28 to secure the suction chamber support 11 and the bearing device 12 to one another. It is to be noted that the bearing device 12 is secured in the housing 2 in a manner not described, thereby also securing the suction chamber support 11 to the housing 2.

For carrying out a massage, the massaging apparatus 1 is movable over a part of a person's body, i.e., over the skin covering a part of a person's body, in a given operating direction indicated by an arrow 29 in FIGS. 1 to 6.

The massaging apparatus 1 further comprises two rollers 30 and 31. Each of the two rollers 30 and 31 is rotatable about one of two spaced-apart mutually parallel roller spindles 32 and 33. For rotatably supporting the two rollers 30 and 31, the bearing device 12 has two bearing walls, of which only a bearing wall 34 is visible in FIG. 6. The bearing wall 34 has two bearing bores 35 and 36, in which the roller spindles 32 and 33 are rotatably supported. With their circumferential surfaces 37 and 38, the two rollers 30 and 31 can be placed onto a person's skin 39, shown diagrammatically as a dotted line in FIG. 3. During the movement of the massaging apparatus 1 and its two rollers 30 and 31 over a person's skin 39 in the operating direction 29, which extends transversely to the roller spindles 32 and 33, the two rollers 30 and 31 can each be driven in a given direction of rotation. In the massaging apparatus 1, the two rollers 30 and 31 are each driven in the same direction of rotation, as indicated by means of two arrows 40 and 41 in FIGS. 2 and 3.

It may be considered to rotate the two rollers 30 and 31, after they have been applied to a person's skin 39, by means of the friction produced between the two rollers 30, 31 and the skin 39, as the massaging apparatus 1 and its two rollers 30 and 31 are moved over the skin 39. However, in the massaging apparatus 1, the two rollers 30 and 31 are motor-driven. For this purpose, as is shown highly diagrammatically for a variant of the massaging apparatus 1 in FIG. 2, the massaging apparatus 1 comprises a roller drive motor 42, which is secured to the bearing device 12. The roller drive motor has a nominal speed of approximately 8000 r.p.m. The roller drive motor 42 drives a first gear wheel 44 via its motor shaft 43, this gear wheel being in mesh with a second gear wheel 45. The second gear wheel 45 is rotatably supported on the bearing device 12 by means of a spindle 46. The second gear wheel 45 is coaxial with and rotationally locked to a third gear wheel 47. The third gear wheel 47 is in mesh with a fourth gear wheel 48, which is rotatably supported on the bearing device 12 by means of a spindle 49. The fourth gear wheel 48 is coaxial with and rotationally locked to a fifth gear wheel 50, which meshes with a sixth gear wheel 51 which is coaxial with and has the same diameter as the second gear wheel 45. The sixth gear wheel 51 is also rotatably supported on the bearing device 12 by means of the spindle 46. The sixth gear wheel 51 is coaxial with and rotationally locked to a seventh gear wheel 52. The seventh gear wheel 52 is in mesh with an eighth gear wheel 53, which is rotatably supported on the bearing device 12 by means of a spindle which is not shown in FIG. 2. The eighth gear wheel 53 is in mesh with a ninth gear wheel 54, which is coaxial with and which is rotationally locked to the roller 30, and with a tenth gear wheel 55, which is coaxial with and which is rotationally locked to the roller 31. By means of the gear wheel mechanism described above, the two rollers 30 and 31 can be rotated in the given directions of rotation 40 and 41 by means of the roller drive motor 42, both rollers being driven with a speed of approximately 50 r.p.m.

Referring to FIG. 3, it is to be noted, with respect to the two rollers 30 and 31, that in the massaging apparatus 1, the forward roller 30, viewed in the given operating direction 29, is wholly made of a comparatively hard material, the circumferential surface 37 of the roller 30 advantageously having a surface roughness ranging between 0 $\mu$m and 2 $\mu$m. The interior of the rearward roller 31, viewed in the operating direction 29, is also made of a comparatively hard material but is surrounded by a shell of a comparatively soft material, the circumferential surface 38 of the rearward roller 31 having a higher surface roughness than the circumferential surface 37 of the forward roller 30. The surface roughness of the circumferential surface 38 of the rearward roller 31 may range approximately between 3 $\mu$m and 6 $\mu$m.

The massaging apparatus 1 further has a suction chamber 56 in the area of the two rollers 30 and 31, this chamber bounding a suction space. The suction chamber 56 has two transverse walls 57 and 58, which extend substantially perpendicularly to the roller spindles 32 and 33, two longitudinal walls 59 and 60, which extend parallel to the roller spindles 32 and 33 and which are connected to the two transverse walls 57 and 58, and a cover wall 61, which is connected both to the two transverse walls 57 and 58 and to the two longitudinal walls 59 and 60. The suction chamber 56 is open in its area which faces a person's skin 39 when the rollers 30 and 31 are applied to the skin 39 of a person. Each of the two longitudinal walls 59 and 60 has a free end 62, 63 adjacent the circumferential surface 37, 38 of a roller 30, 31, this free end—viewed in the direction of the roller spindles 32 and 33—having a shape which is substantially straight only in its center portion and which extends parallel to the two roller spindles 32 and 33 but which is curved in its two end portions.

The suction chamber 56—as is apparent particularly from FIG. 5—has two juxtaposed connection tubes 64 and 65. By means of the first connection tube 64, the suction chamber 56 is connected to a pump 67 via a first air-transfer line 66, shown in FIG. 3, for the transfer of air, this pump 67 being disposed in the massaging apparatus 1 and being secured to the bearing device 12. The pump 67 comprises a pump motor 68 for driving an air-pumping device of the pump 67. In the present case, the first air-transfer line 66, between the first connection tube 64 and the pumps 67, comprises a first hose section 69 fitted onto the first connection tube 64, a first T-piece 70, which is connected to the first hose section 69, and a second hose section 71, which is connected to the first T-piece 70 and to a pump connection, not shown in FIG. 3. When the rollers 30 and 31 are applied to the skin 39 of a person, the pump 67 can generate a partial vacuum in the suction chamber 56 in order to draw a skin fold 72 into the suction chamber 56, shown diagrammatically as a dotted line in FIG. 3.

In the massaging apparatus 1, the afore-mentioned vacuum-elimination valve device 7 is connected to the first T-piece 70 via a third hose section 73. The vacuum-elimination valve device 7 comprises two air valves, of which an air valve 74 is shown in FIG. 3. The air valve 74 can be opened by actuation of the push-button 6. When the air valve 74, or the second air valve, which can be opened by actuation of the push-button 5 and which is not visible in FIG. 3, is open, the partial vacuum previously formed in the suction chamber 56 by means of the pump 67 is eliminated via the third hose section 73, the first T-piece 70, the first hose section 69 and the connection pipe 64. This is advantageous in view of an easy and painless withdrawal of the suction chamber 56 , i.e., of the massaging apparatus 1, from the skin 39 of a person.

In the massaging apparatus 1, a second air-transfer line 75 is connected to the second connection tube 65 of the suction chamber 56. The second air-transfer line 75 comprises a fourth hose section 76 fitted onto the second connection tube 65 of the suction chamber 56, a second T-piece 77, which is connected to the fourth hose section 76, and a fifth hose section 78, which is connected to the second T-piece 77 and to a vacuum control valve 79, by means of which a desired vacuum in the suction chamber 56 can be selected by suitably turning the rotary knob 10. As long as a vacuum, which can be generated in the suction chamber 56 of the massaging apparatus 1 by the pumping action of the pump 67, is not yet reached, the vacuum control valve 79 is in its closed condition. However, when a desired vacuum in the suction chamber 56 is exceeded, the vacuum control valve 79 opens automatically, allowing leakage air to flow into the suction chamber 56 via the air-transfer line 75 until the desired partial vacuum is established in the suction chamber 56.

In the massaging apparatus 1, an electropneumatic vacuum switch 81 is connected to the second T-piece 77 via a sixth hose section 80. For a given value of the vacuum, the vacuum switch 81 performs an electrical switching function. The vacuum switch 81 performs an electrical switching function, for example, at a given vacuum having a value of approximately 80 millibar. In the massaging apparatus 1, the vacuum switch 81 forms part of a motor supply device, not shown, for the roller drive motor 42, the vacuum switch 81 enabling the roller drive motor 42 to be turned on when a given vacuum in the suction chamber 56 is reached. This has the advantage that, after the massaging apparatus 1 and its two rollers 30 and 31 have been applied to the skin 39 of a person, the two rollers 30 and 31 are not driven until a given vacuum in the suction chamber 56 has been reached and, consequently, a skin fold 72 has been formed.

Figure 1:
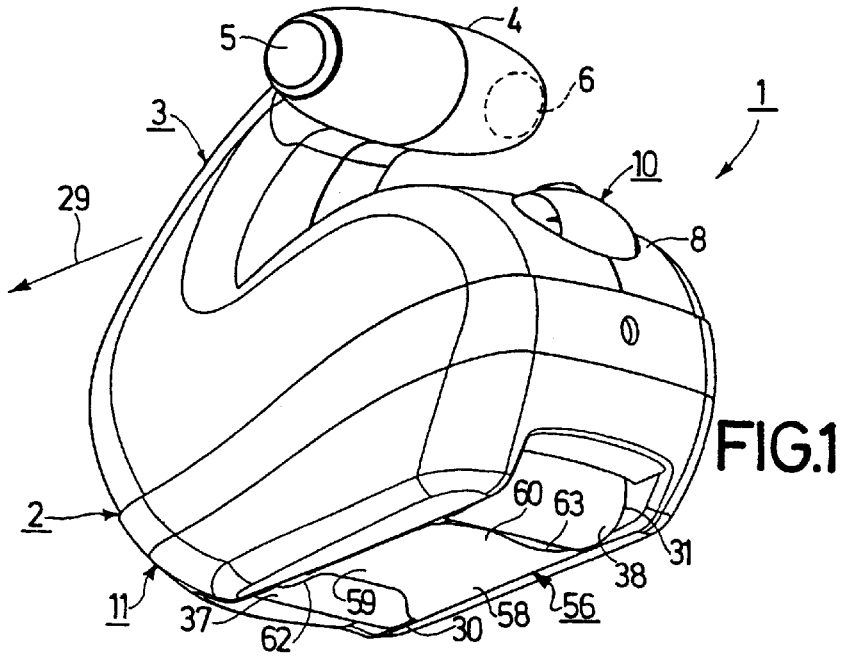
FIG. 1 is an oblique underneath view showing a massaging apparatus in accordance with a first embodiment of the invention, which comprises two rotationally drivable rollers and suction chamber having two longitudinal walls and two transverse walls, both the two longitudinal walls and the two transverse walls of the suction chamber being essentially disposed between the two rollers.
Figure 2:
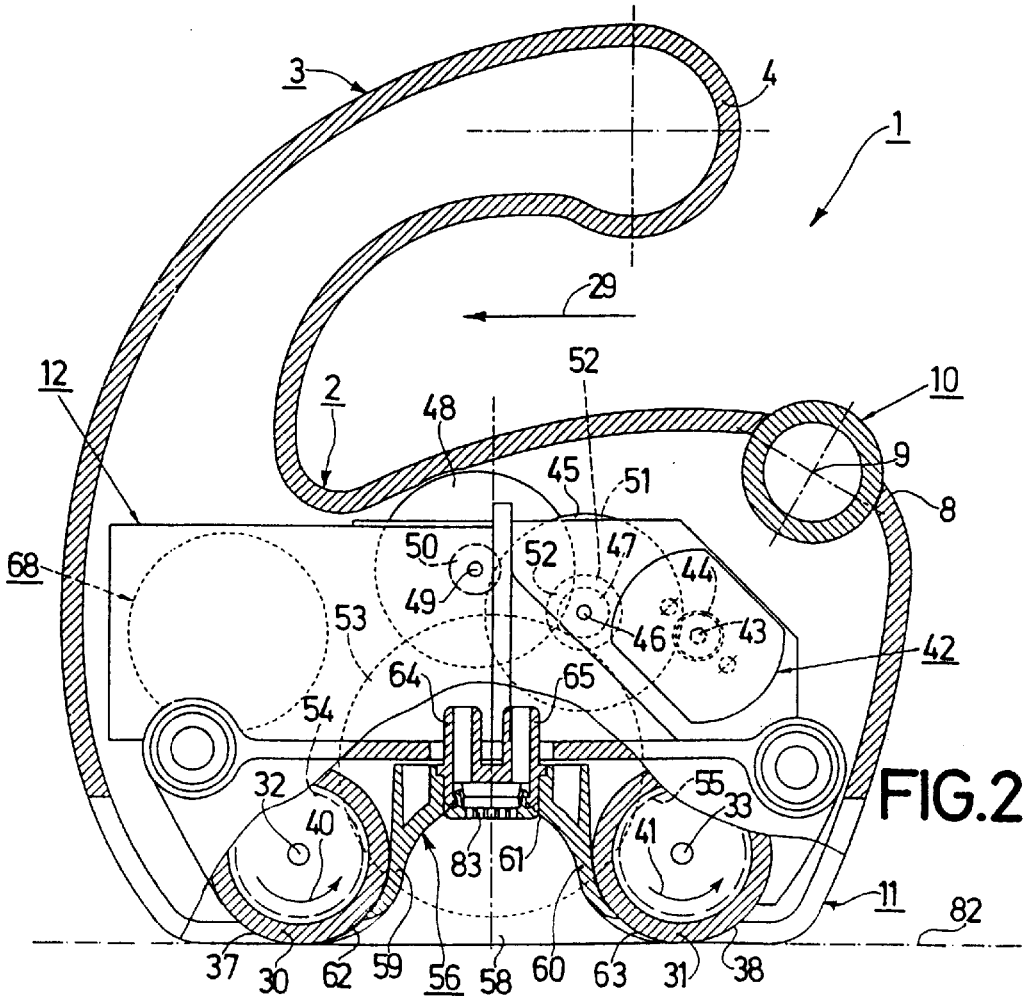
FIG. 2 shows a variant of the massaging apparatus of FIG. 1 in a sectional view taken substantially across the center of the massaging apparatus, FIG. 2 diagrammatically showing, in particular, the drive means for driving the two rotationally drivable rollers.

As is apparent from FIGS. 1 to 3, the two longitudinal walls 59 and 60 of the suction chamber 56 in the massaging apparatus 1 are now interposed between the two rollers 30 and 31. Moreover, the two transverse walls 57 and 58 of the suction chamber are also disposed substantially between the two rollers 30 and 31. As is further apparent from FIGS. 1 to 3, each free end 62 or 63 of a longitudinal wall 59 or 60 interposed between the two rollers 30 and 31, then extends up to the respective circumferential surface 37 or 38 of the roller 30 or 31 adjacent this free end 62 or 63 in its circumferential surface area which faces the other roller 31 or 30. In the present massaging apparatus 1, the respective free end 62 or 63 of each of the two longitudinal walls 59 and 60 extends up to the respective circumferential surface 37 or 38 of a roller 30 or 31 so as to form an air gap, not shown, having a gap width of approximately 0.1 mm. The gap width of the air gap between the free ends 62 and 63 of the longitudinal walls 59 and 60 and the circumferential surfaces 37 and 38 of the two rollers 30 and 31 can alternatively have a smaller value of, for example, 0.05 mm but also a larger value of, for example, 0.15 mm to 0.2 mm.

As is apparent from FIGS. 1 to 5 and, particularly, from FIGS. 1, 4 and 5, the greater part of the free end 62, 63 of each of the two longitudinal walls 59 and 60 recedes towards the apparatus interior from a tangential plane indicated by a dash-dot line 82 in FIG. 2, this plane being common with the two rollers 30 and 31 in their areas which face the skin 39 of a person when the rollers 30 and 31 are applied to the skin 39 of a person. This is very advantageous in view of a low friction of the longitudinal walls 59 and 60 of the suction chamber 59 on the skin 39 of a person and in view of maximal contact areas of the two rollers 30 and 31 on the skin 39 of a person.

As is also apparent from FIGS. 1 to 4, the two longitudinal walls 59 and 60, the two transverse walls 57 and 58, and the cover wall 61 of the suction chamber 56 bound a dome-like suction space of substantially ellipsoidal shape without any corners inside the suction chamber 56, which is favorable for a comfortable and careful massage of a skin fold 72.

It is to be noted that in the massaging apparatus 1, the two longitudinal walls 59 and 60 and the two transverse walls 57 and 58 of the suction chamber 56 have a surface roughness of approximately 6 $\mu$m at the location of their bounding surfaces which can be brought into contact with the skin 39 of a person. However, these bounding surfaces can alternatively have a surface roughness of 4 $\mu$m, 5 $\mu$m, 7 $\mu$m or 8 $\mu$m. Such a surface roughness has proven to be advantageous for a low adhesion of the walls 57, 58, 59 and 60 of the suction chamber 56 to the skin 39 of a person and, consequently, for a minimal friction between the walls 57, 58, 59 and 60 of the suction chamber 56 to the skin 39 of a person.

With respect to the suction chamber 56, it is to be noted that in the area of the cover wall 61 of the suction chamber 56, a filter 83 is arranged in a passage leading to the two connection pipes 64 and 65, as can be seen in FIGS. 2 and 3.

Referring to FIG. 5, it is to be noted with respect to the suction chamber 56 and the suction chamber support 11, that in the interior of the apparatus, the suction chamber 56 has three mounting sleeves 84, 85 and 86 which are integral with the suction chamber 56 and into which the fixing bolts passed through the bearing device 12 can be screwed, thus providing an additional fixed connection between the suction chamber support 11 and the bearing device 12.

The massaging apparatus 1, as can be seen in FIG. 3, comprises a dirt scraper 87 adjacent that area of the circumferential surface of the rearward roller 31 in the given operating direction 29, which is remote from forward roller 30 in the given operating direction 29, this scraper being urged onto the circumferential surface 38 of the rearward roller 31 in the given operating direction 29 by means of a spring 88 in the form of a leg spring. This dirt scraper 87 ensures that in the area of the rearward roller 31 in the given operating direction 29, no ingress of dirt into the massaging apparatus 1 is possible and that the skin 39 of a person cannot get trapped in the area of the rearward roller 31 in the given operating direction 29 because this is precluded by the dirt scraper 87, which is urged onto the circumferential surface 38 of the roller 31.

Due to the fact that, in the massaging apparatus described above, both the two longitudinal walls and the two transverse walls of the suction chamber are arranged between the two rollers, it is simply achieved that the contact area of the suction chamber on the skin is particularly small, as a result of which it is simple to achieve a proper sealing between a person's skin and the suction chamber, i.e., the two longitudinal walls and the two transverse walls of this chamber. The particularly small contact area of the suction chamber, i.e., its walls, with a person's skin has the advantage that only small frictional forces occur between the walls of the suction chamber and a person's skin and only a low surface pressure occurs between the walls of the suction chamber and a person's skin, as a result of which the massaging apparatus can be moved over a person's skin with small forces. A further advantage of the massaging apparatus described above is that the suction chamber can have a very small volume, as a result of which the evacuation of air from the suction chamber by means of a pump of given pump capacity incorporated in the massaging apparatus can be effected in a comparatively short time in order to reach a certain desired vacuum. Due to the small volume of the suction chamber, the massaging apparatus can be comparatively compact at least at the location of the suction chamber. Moreover, a special advantage of the massaging apparatus described above is that the suction chamber itself is absolutely sealed so that there are absolutely no air leakage problems at the location of the suction chamber walls and, as a consequence, a particularly rapid build-up of a vacuum in the perfectly sealed suction chamber is possible. Furthermore, it is to be noted that due to the dome-like rounded shape of the suction chamber in its interior, a particularly gentle cooperation of the suction chamber with the skin fold which has been drawn into suction chamber is guaranteed and an advantageously high mechanical stiffness of the suction chamber is achieved. The rotatable mounting of the two rollers of the massaging apparatus in the bearing walls of the bearing device which is fixedly connected to the suction chamber and the suction chamber support has the advantage that, by means of the bearing walls of the bearing device, the two rollers are rotatably supported in a fixed relationship with the suction chamber, i.e., the walls of the suction chamber, which is advantageous in view of a constant relative position of the rollers with respect to their adjacent longitudinal walls and, consequently, in view of a constant air gap between each roller and its adjacent longitudinal wall. The selected surface roughnesses of the circumferential surfaces of the two rollers in the massaging apparatus described above ensures a particularly favorable cooperation of the rollers with a person's skin. In view of a minimal friction between the longitudinal walls of the suction chamber and a person's skin, it has also proven to be favorable that the longitudinal walls with their free ends, for the greater part, recede into the interior of the apparatus.

Figure 7:
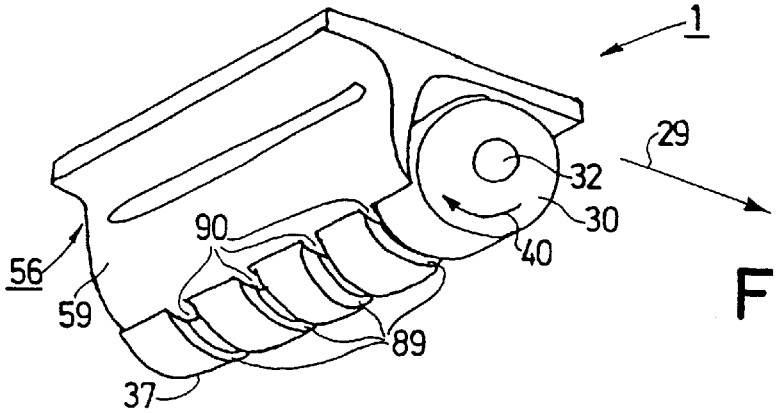
FIG. 7 shows a roller of a massaging apparatus in accordance with a second embodiment of the invention.

FIG. 7 shows only a detail of a massaging apparatus in accordance with a second embodiment of the invention. This detail concerns the forward roller 30, viewed in the given operating direction 29 of the massaging apparatus 1, this roller being rotationally drivable about the roller spindle 32 in the direction indicated by the arrow 40. The longitudinal wall 59 of the suction chamber 56, which is shown only partly, is disposed behind the roller 30, viewed in the given operating direction 29.

In the massaging apparatus 1 shown in FIG. 7, the roller 30 has circumferential grooves 89. Furthermore, in this massaging apparatus 1, the longitudinal wall 59, which follows the roller 30, viewed in the given operating direction 29, has tooth-like wall extensions 90, each wall extension 90 engaging in a groove 89 of the roller 30. In the present case, the wall extensions 90 are formed as comparatively short projections of the longitudinal wall 59.

Figure 8:
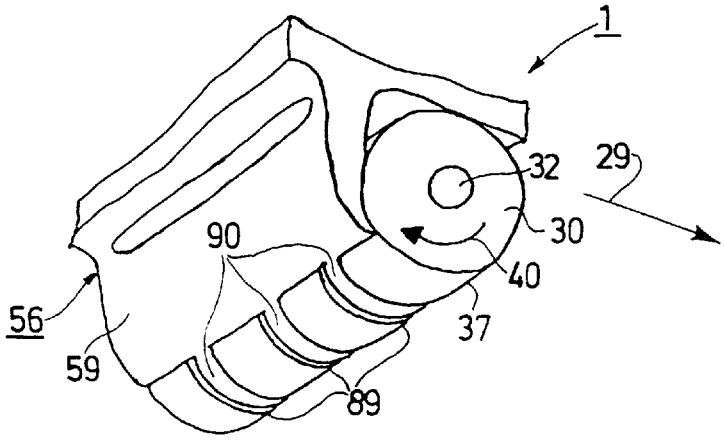
FIG. 8 shows a roller of a massaging apparatus in accordance with a third embodiment of the invention.

FIG. 8, in the same way as FIG. 7, shows a detail of a massaging apparatus in accordance with a third embodiment of the invention. This Figure also shows the forward roller 30, viewed in the given operating direction 29, and the longitudinal wall 59 of the suction chamber 56 of this massaging apparatus 1, this wall being disposed adjacent this roller 30. The roller 30 of this massaging apparatus 1 also has grooves 89, in which the wall extensions 90 of the longitudinal wall 59 engage. In the present case, the wall extensions 90 are formed by comparatively long arcuate projections of the longitudinal wall 59, the arcuate shape of these projections having a radius substantially equal to the radius of the roller 30.

Figure 9:
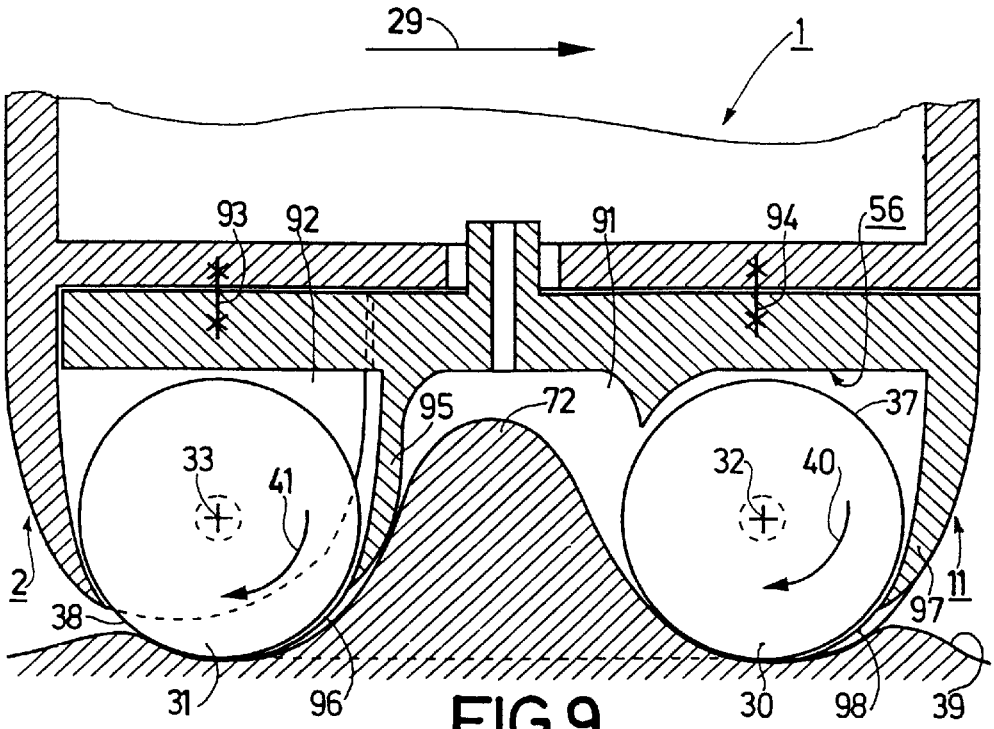
FIG. 9 is a highly diagrammatic sectional view of a massaging apparatus in accordance with a fourth embodiment of the invention.

FIG. 9 is a highly diagrammatic view showing a massaging apparatus in accordance with a fourth embodiment of the invention. In this massaging apparatus only one longitudinal wall of the suction chamber 56 is interposed between the two rollers 30 and 31, which are rotationally drivable in the directions indicated by the arrows 40 and 41 in accordance with the given operating direction 29. The roller spindle 32 of the forward roller 30, in the given operating direction 29, is rotatably supported in the two transverse walls of the suction chamber 56 in the massaging apparatus 1 shown in FIG. 9. Of the transverse walls of the suction chamber 56, only a transverse wall 91 is shown in FIG. 9. The roller spindle 33 of the rearward roller 31 in the given operating direction 29 is rotatably supported in two transverse wall portions of the housing 2 in the massaging apparatus 1 shown in FIG. 9. Of these two transverse wall portions of the housing 2 only a transverse wall portion 92 is shown in FIG. 9.

In the massaging apparatus 1 shown in FIG. 9, the suction chamber 56 also forms part of a suction chamber support 11. In the present case, the suction chamber support 11 is directly secured to the housing 2 by means of diagrammatically shown screwthread connections.

As already stated, only one longitudinal wall of the suction chamber 56 is interposed between the two rollers 30 and 31 in the massaging apparatus 1 shown in FIG. 9. This is the longitudinal wall 95 of the suction chamber 56, whose free end 96 extends up to the circumferential surface 38 of the rearward roller 31 in the given operating direction 29. The second longitudinal wall 97 of the suction chamber 56, whose free end 98 extends up to the circumferential surface 37 of the forward roller 30 in the given operating direction 29, precedes the roller 30, viewed in the given operating direction 29, and is, consequently, not disposed between the two rollers 30 and 31. In spite of this, the massaging apparatus 1 shown in FIG. 9 also has a comparatively small contact area for the suction chamber 56 on the skin 39 of a person and the suction chamber 56 has a comparatively small volume.

Figure 10:
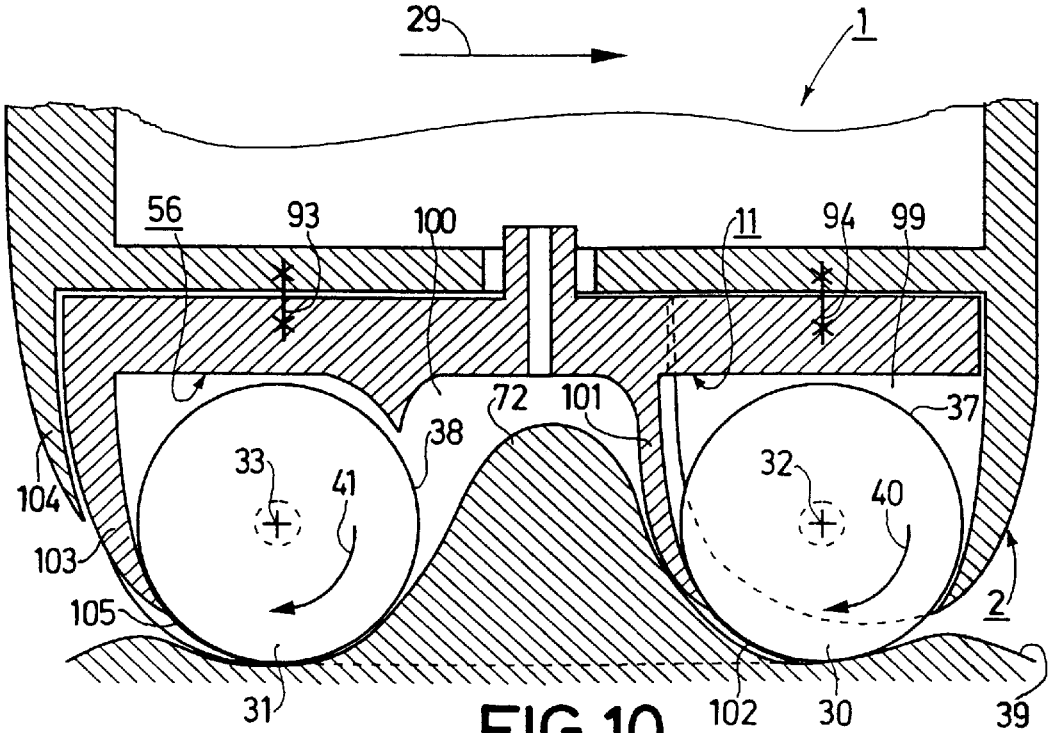
FIG. 10, similarly to FIG. 9, shows a highly diagrammatic sectional view of a massaging apparatus in accordance with a fifth embodiment of the invention.

FIG. 10, in the same way as FIG. 9, shows a massaging apparatus 1 in accordance with a fifth embodiment of the invention. In comparison with the massaging apparatus as shown in FIG. 9, the massaging apparatus shown FIG. 10 is of a substantially mirror-inverted construction, as is apparent from FIG. 10. In the massaging apparatus 1 as shown in FIG. 10, the roller spindle 32 of the forward roller 30 in the given operating direction 29 is rotatably supported in two transverse wall portions of the housing 2. Of these two transverse wall portions of the housing 2, only a transverse wall portion 99 is shown in FIG. 10. The roller spindle 33 of the rearward roller 31 in the given operating direction 29 is rotatably supported in the two transverse walls of the suction chamber 56. Of the two transverse walls of the suction chamber 56, only a transverse wall 100 is shown in FIG. 10.

In the massaging apparatus 1 shown in FIG. 10, only one longitudinal wall of the suction chamber 56 is disposed between the two rollers 30, i.e., the longitudinal wall 101 of the suction chamber 56, whose free end 102 extends up to the circumferential surface 37 of the forward roller 30 in the given operating direction 29. The second longitudinal wall 103 of the suction chamber 56, which is partly covered by a longitudinal wall portion 104 of the housing 2 and whose free end 105 extends up to the circumferential surface 38 of the roller 31 in the given operating direction 29, follows the roller 31, viewed in the given operating direction 29, and is, consequently, not disposed between the two rollers 30 and 31.

In the massaging apparatus 1 shown in FIG. 10, the construction of the suction chamber 56 is such that of the two longitudinal walls 101 and 103 of the suction chamber 56, the respective free ends 102 and 105 of both longitudinal walls 101 aid 103 are urged under pre-load against the circumferential surfaces 37 and 38 of the rollers 30 and 31 adjacent the respective free ends 102 and 105. This pre-load is obtained by an appropriate design of the longitudinal walls 101 and 103, which has been chosen in such a manner that during assembly of the massaging apparatus 1 shown in FIG. 10, the two longitudinal walls 101 and 102 are loaded by the rollers 30 and 31 at the location of their free ends 102 and 105, which gives rise to the pre-load in the two longitudinal walls 101 and 103. It is to be noted that a pre-load to keep the free end of a longitudinal wall urged against the circumferential surface of the roller adjacent this free end need not necessarily be obtained by the design of the relevant longitudinal wall, but can also be achieved by the provision of a separate spring, such as a blade spring, which can be integrated, at least partly, in a longitudinal wall.

The massaging apparatus 1 shown in FIG. 10 also has the advantages of a comparatively small contact area of the walls of the suction chamber 56 on the skin 39 of a person and a comparatively small volume of the suction chamber 56.

The invention is not limited to the embodiments described above. The measures in accordance with the invention can also be applied advantageously to massaging apparatuses of different constructions. In this respect it is to be noted, for example, that in a massaging apparatus comprising two rollers which are rotationally drivable by means of a roller drive motor it is alternatively possible to provide independent drive transmissions which are, at least partly, independent from one another between the roller drive motor and each of the two rollers, and to drive the forward roller, viewed in the given operating direction of a massaging apparatus, with a higher speed than the rearward roller, viewed in the given operating direction of a massaging apparatus, as a result of which it is achieved that the forward roller, which is driven with a higher speed, tends to feed more skin or tissue into the suction cone than is moved out of the suction chamber by the rearward roller, which is driven more slowly, thereby assisting the two rollers in the formation of a skin fold which is drawn into the suction chamber of such a massaging apparatus. In a massaging apparatus in accordance with the invention, it is also possible that only one of the two rollers is motor-driven, which driven roller can be the forward roller in the given operating direction but alternatively and sometimes even preferably this can be the rearward roller in the given operating direction. As already stated, a motor drive for the two rollers can be dispensed completely in a massaging apparatus in accordance with the invention, and the rollers can be driven by the mere friction between a person's skin and the rollers, but this may lead to an irregular drive of the two rollers and even to a brief standstill of a roller.

We claim:

1. A massaging apparatus comprising:

two rollers each rotatable about one of two mutually parallel spaced-apart roller spindles, said two rollers having circumferential surfaces placeable onto the skin of a person and being rotatable in a given direction of rotation when the massaging apparatus is moved over the skin of a person in a given operating direction which extends transversely to the roller spindles;

a suction chamber in the area of the two rollers, said suction chamber enclosing a suction space and comprising two transverse walls extending substantially perpendicularly to the roller spindles, and two longitudinal walls extending parallel to the roller spindles, said two longitudinal walls being connected to the two transverse walls, each of said two longitudinal walls having a free end adjacent the circumferential surface of a respective one of said two rollers, each of said free ends extending to a position between a plane defined by the roller spindles and a person's skin when the two rollers are applied to the skin of the person, said suction chamber being open in an area facing a person's skin when the two rollers are applied to the skin of the person; and a pump for transferring air from the suction chamber via an air-transfer connection in the suction chamber, said pump, when the two rollers are applied to the skin of a person, generating a partial vacuum in the suction chamber in order to form a skin fold which is drawn into the suction chamber, characterized in that at least one of said two longitudinal walls of the suction chamber is disposed substantially between the two rollers, the free end of said at least one longitudinal wall disposed between the two rollers extending to the circumferential surface of the respective roller in that area of the circumferential surface which faces the other roller, said at least one longitudinal wall limiting the suction space of said suction chamber to an area between said at least one longitudinal wall, having said free end lying adjacent the circumferential surface of said one roller and between the two rollers and extending to a position between the plane defined by the roller spindles and a person's skin when the two roller are applied to the skin of a person, and at least the other longitudinal wall having the free end lying adjacent the circumferential surface of the other roller and extending to a position between the plane defined by the roller spindles and a person's skin when the two roller are applied to the skin of a person.

2. A massaging apparatus as claimed in claim 1, wherein the free end of said at least one longitudinal wall of the suction chamber extends up to the circumferential surface of a rearward one of said two rollers, viewed in the given operating direction, and is disposed substantially between the two rollers.

3. A massaging apparatus as claimed in claim 2, wherein said massaging apparatus further comprises:

a dirt scraper disposed adjacent the circumferential surface of the rearward one of said two rollers, viewed in the given operating direction, remote from a forward one of said two rollers, viewed in the given operating direction; and at least one spring for urging said dirt scraper onto the circumferential surface of the rearward roller, viewed in the given operating direction.

4. A massaging apparatus as claimed in claim 1, wherein both of the two longitudinal walls of the suction chamber are disposed substantially between the two rollers.

5. A massaging apparatus as claimed in claim 4, wherein, in addition, the two transverse walls of the suction chamber are also disposed substantially between the two rollers.

6. A massaging apparatus as claimed in claim 5, wherein the two longitudinal walls and the two transverse walls of the suction chamber form a dome-like suction space of substantially ellipsoidal shape without any corners inside the suction chamber.

7. A massaging apparatus as claimed in claim 4, wherein said massaging apparatus further comprises bearing walls for rotatably supporting the two rollers, said bearing walls extending transversely to the roller spindles and projecting laterally from the suction chamber, said bearing wall being fixedly connected to the suction chamber disposed between the two rollers.

8. A massaging apparatus as claimed in claim 7, wherein the suction chamber forms part of a suction chamber support, the bearing walls form parts of a bearing device, and the suction chamber support is fixedly connected to the bearing device.

9. A massaging apparatus as claimed in claim 1, wherein the circumferential surface of at least a forward roller of said two rollers, viewed in the given operating direction, has a surface roughness in a range between 0 $\mu$m and 2 $\mu$m.

10. A massaging apparatus as claimed in claim 1, wherein the two longitudinal walls and the two transverse walls of the suction chamber have surface roughnesses in a range between 4 μm and 8 μm where the two longitudinal walls and the two transverse walls are in contact with the skin of a person when the massaging apparatus is in use.

11. A massaging apparatus as claimed in claim 1, wherein the free end of each of the two longitudinal walls recedes towards an interior of the massaging apparatus with respect to a tangential plane common to the circumferential surfaces of the two rollers where the circumferential surfaces contact the skin of a person.

12. A massaging apparatus as claimed in claim 1, wherein the free end of each of the two longitudinal walls extends up to the circumferential surface of a respective one of the two rollers so as to form an air gap having a gap width of at the most 0.2 mm.

13. A massaging apparatus as claimed in claim 12, wherein the free end of at least one longitudinal wall of the two longitudinal walls of the suction chamber is urged against the circumferential surface of the respective one of the two rollers adjacent this free end under a pre-load.

14. A massaging apparatus as claimed in claim 1, wherein one of said two rollers which, viewed in the given operating direction, is followed by one of the two longitudinal walls of the suction chamber, has circumferential grooves formed in the circumferential surface, and the one longitudinal wall following said one roller has tooth-like wall extensions arranged at the free end thereof for engaging, respectively, with the circumferential grooves formed in the circumferential surface of said one roller.

* * * * *